United States Patent [19]

Alderman

[11] 4,290,247

[45] Sep. 22, 1981

[54] FLUID FLOW INSULATION SYSTEM

[76] Inventor: Robert J. Alderman, 812 59th St., NW., Bradenton, Fla. 33505

[21] Appl. No.: 60,841

[22] Filed: Jul. 26, 1979

[51] Int. Cl.[3] ..... F24F 7/10

[52] U.S. Cl. ..... 52/173 R; 52/95; 52/303; 98/31; 165/53; 165/56

[58] Field of Search ..... 52/95, 169.11, 173, 52/198, 220, 302, 303, 404, 503, 576, 577, 743; 98/29, 31, 33 R, 33 A, DIG. 7; 165/53, 54, 56, 138, 168, 169, 171

[56] References Cited

U.S. PATENT DOCUMENTS

| | | | |
|---|---|---|---|
| 2,221,001 | 11/1940 | Lucius . | |
| 2,969,027 | 1/1961 | Figge | 52/303 X |
| 2,988,980 | 6/1961 | Tschudin | 98/31 |
| 3,049,067 | 8/1962 | Claude | 98/31 |
| 3,115,819 | 12/1963 | Mahlmeister et al. | 98/31 X |
| 3,167,159 | 1/1965 | Bovenkerk | 52/303 X |
| 3,376,834 | 4/1968 | Thoren | 98/31 X |
| 3,633,659 | 1/1972 | Ohlsson | 165/56 |
| 3,727,538 | 4/1973 | Jacobson | 52/198 X |
| 3,789,747 | 2/1974 | Wasserman et al. | 52/303 X |
| 3,994,278 | 11/1976 | Pittinger | 165/53 X |
| 4,000,850 | 1/1977 | Diggs | 52/173 R X |
| 4,096,790 | 6/1978 | Curran | 52/198 X |
| 4,102,092 | 7/1978 | Ward | 52/95 X |
| 4,114,334 | 9/1978 | Thoren | 52/303 |
| 4,148,293 | 4/1979 | Lents et al. | 126/270 |

*Primary Examiner*—J. Karl Bell

*Attorney, Agent, or Firm*—Jones, Thomas & Askew

[57] ABSTRACT

A heat insulation system for an attic and the like comprises a moving fluid barrier between layers of static insulation. In the disclosed embodiment the fluid barrier comprises a plane of moving air which extends over substantially the entire surface to be insulated. A method of circulating air through the air passage of the air barrier to reduce the temperature gradient between the attic and an underlying room is also disclosed.

19 Claims, 8 Drawing Figures

FLUID FLOW INSULATION SYSTEM

TECHNICAL FIELD

The present invention relates generally to heat insulation systems for buildings and other objects, and, more particularly, to such a system for use in an attic of a building to reduce the temperature gradient between the attic and an underlying room, thereby reducing the amount of heat exchange therebetween.

BACKGROUND

Dwelling houses and other structures made for human occupancy usually include a sloped roof structure with an attic space between the roof structure and the dwelling rooms therebelow. The dwelling rooms usually are heated and cooled to maintain a desired temperature range of between approximately 68° F. and 74° F. which is comfortable to the occupants, but the temperature of the attic space varies widely, from very low temperatures in the winter months to very high temperatures during the summer months. Thus, the temperature gradient from the dwelling rooms, across the ceiling to the attic frequently is high. Also, a similar temperature gradient usually is present from the inside wall surfaces to the outside wall surfaces of the dwelling. The rate at which heat will flow through the ceiling and walls into or out of a room is dependent upon at least two factors: the difference between the temperature inside the room and the temperature outside the room, and the efficiency with which the ceiling, roof, walls and flooring of the building between the high and low temperatures conduct heat. In order to reduce the rate of heat flow into or out of the room, it is typically the practice to provide insulating materials in the walls and ceiling of such buildings. Such insulating materials include mineral wool, urethane foams and the like which are well known in the art.

The ceiling of a room is a particularly important area for insulation because the majority of the heat transfer takes place through the ceiling. This is true because during summer, attic temperature may reach as high as 150° F., even though outside temperatures are approximately 90° F., due to radiation heating, while the temperature of the rooms below the ceiling are maintained close to 70° F., sometimes resulting in a temperature gradient across the ceiling of more than 70° F. Furthermore, during winter seasons room temperature of 80° F. adjacent the ceiling is often required to provide an overall temperature of 72° F. in the room below, while the temperature in the attic may be below freezing, resulting in a temperature gradient across the ceiling of about 50° F.

Although providing conventional insulating materials in the walls and on the attic floor of a building is effective at reducing heat transfer through the walls and ceiling, the insulation materials are expensive, are bulky to handle and to install, and in some instances are not very effective.

BRIEF DESCRIPTION OF THE INVENTION

Generally, the present invention relates to an air insulation system for use as a heat transfer barrier between, for example, an attic of a building and the dwelling rooms therebelow, to reduce the transfer of heat across the ceiling. More particularly, the present invention comprises a heat insulation system wherein hot and cold areas are insulated from each other with static insulation and a layer of fluid at an intermediate temperature is moved internally through the static insulation to change the temperature gradient across the static insulation and reduce the transfer of heat to or from the preferred temperature surface. Optionally, the layer of fluid is moved through the static insulation at a position close to the undesirable temperature surface of the static insulation so as to increase the temperature gradient between the stream of fluid and the undesirable temperature surface and reduce the temperature gradient between the stream of fluid and the desirable temperature surface. In the disclosed embodiment the layer of fluid comprises an air barrier formed by at least one air passage sized and shaped to extend over substantially the entire surface to be insulated. Atmospheric air from outside the building can be circulated through the air passage. Additionally, outside air can be circulated through a warm heat exchanger during the winter months so that the outside air can be heated by waste combustion gases from a furnace, a fireplace or the like. The heated air can then be circulated through the air passage of the air insulation system. In the disclosed embodiment the air barrier comprises a plurality of adjacent, substantially parallel rectilinear boxes with laminated corrugated side walls which are collapsible for shipment and storage and during placement in the attic, but which are opened when placed in the attic.

The interior of the boxes forms a dead air space lined with reflective sheet material such as aluminum foil and at least one of the horizontal corrugated side walls of each box forms a passage for a plane of moving air. Static insulation, such as loose or batt insulation, is placed beneath and over the boxes. A blower is connected to a header which is connected to the open end of a corrugated side wall of each box to move a plane of air through the channels formed by the corrugations of the side wall. Thus, the upper and lower layers of static insulation have a dead air space, a reflective surface and a moving plane of air disposed between them.

Accordingly, it is an object of the present invention to provide an improved heat insulation system for a dwelling and the like.

Another object of the present invention is to provide a heat insulation system for a dwelling which reduces heat flow through the ceiling of the dwelling and which utilizes waste heat from the dwelling to reduce the temperature gradient across the ceiling.

A further object of the present invention is to provide an insulation system for a dwelling which utilizes outside air and air moderately heated by waste heat from the heating system or other heat sources of the dwelling to reduce the heat transfer across a ceiling or wall of the dwelling.

Another object of this invention is to provide an improved heat insulation system for placement between relatively hot and cold surfaces wherein a plane of moving fluid passes between adjacent layers of static insulation to reduce the temperature gradient adjacent the desired temperature surface.

Yet another object of the present invention is to provide an air insulation system which is constructed of relatively inexpensive, plentiful materials which can be folded or collapsed to a reduced size for shipment and expanded for assembly at an installation site.

These and other objects, features and advantages of the present invention will become apparent from a review of the following detailed description of the disclosed embodiment and the appended drawing and claims.

DETAILED DESCRIPTION OF THE DISCLOSED EMBODIMENTS

Figure 1:
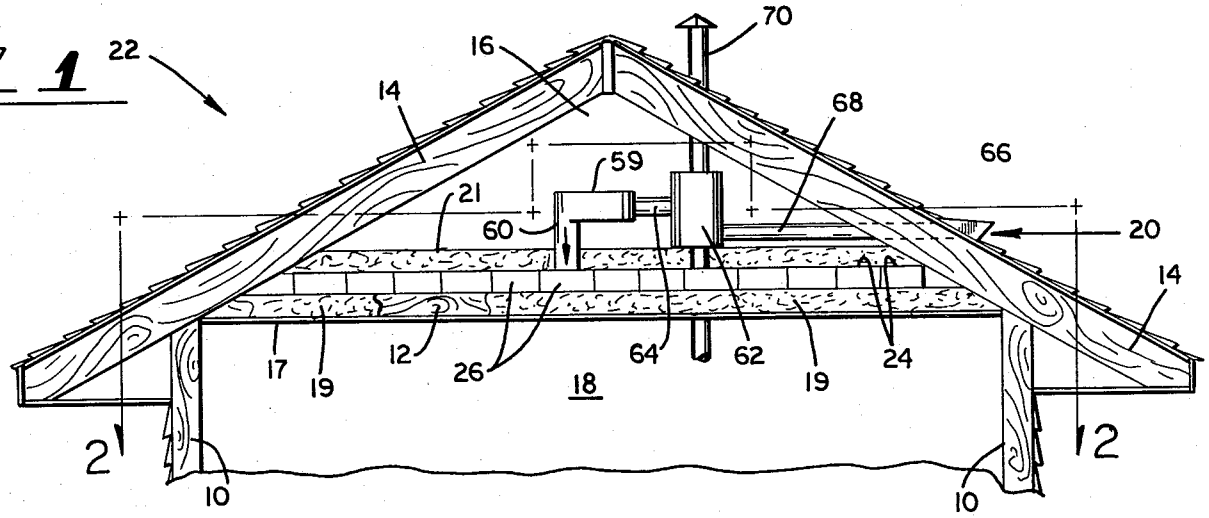
FIG. 1 is a schematic cross-sectional view of a disclosed embodiment of the fluid flow insulation system installed in the attic of a prior art dwelling such as a residential home.

Referring now to the drawing in which like numbers indicate like elements throughout the several views, an embodiment of the fluid flow insulation system is disposed in the attic 16 of a typical building 22, such as a residential home. The joists 12 of the building structure extend transversely between the two opposed walls 10 and define a substantially horizontal support surface in the floor of the attic 16 and a surface against which the ceiling 17 of the room 18 is mounted. Conventional static insulation 9 such as loose or batt fiberglass insulation can be provided between the adjacent joists 12 on top of the ceiling 17.

Figure 3:
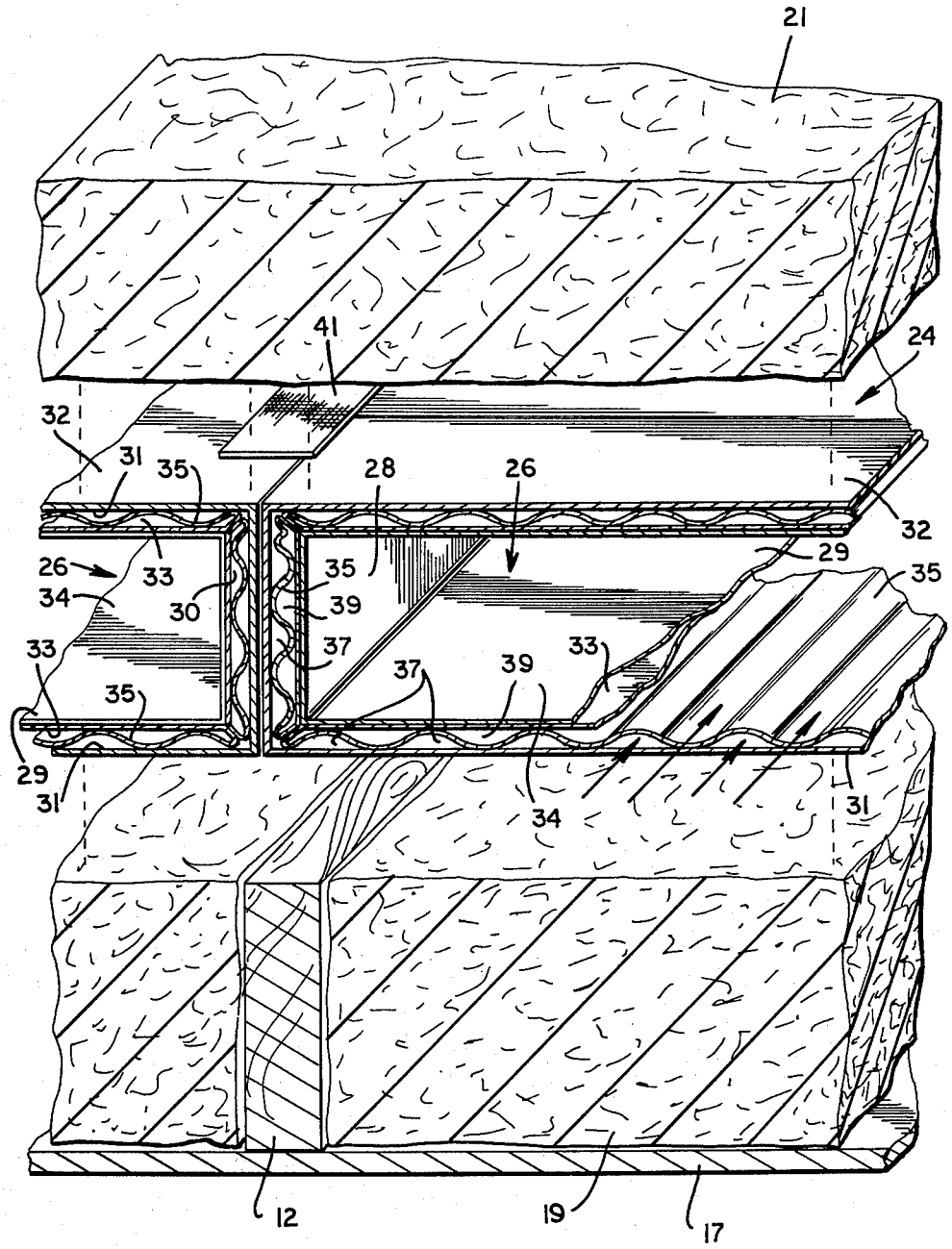
FIG. 3 is a partial exploded perspective cross-sectional view of one of the boxes and its surrounding elements shown in FIG. 1.

Disposed on the support surface defined by the joists 12 are a plurality of rectilinear boxes 24 which define discrete air chambers 26. As illustrated in FIG. 3, each box includes two side walls 28, 30, a top wall 32 and a bottom wall 34. The four walls 28–34 are made from corrugated cardboard which is relatively light in weight, relatively inexpensive and strong. The interior surfaces of the walls 28–34 which define the air chamber 26 are preferably provided with a heat reflective surface or coating, such as aluminum foil 29 adhesively mounted on the interior surfaces. The walls 28–34 each include at least one ply of corrugated cardboard, comprising an outer sheet 31, inner sheet 33 to which the aluminum foil is adhered, and the intermediate corrugated sheet 35. The corrugated sheet 35 defines a plurality of small elongated air passages 37 and 39 through the walls of the box 24.

The boxes 24 are disposed on the joists 12 or other support surface of the attic with their long dimensions extending either perpendicular to or parallel to the lengths of the parallel joists 12. Each individual box 24 is disposed adjacent to and substantially parallel to its adjacent boxes. Since it is desirable to provide the maximum amount of insulation to the room 18, it is desirable to cover substantially all of the attic support surfaces with boxes. Since the boxes 24 are made of cardboard, they can be easily cut to the desired length and a sufficient number of adjacent boxes can be used to span the desired width of the support surface. Adhesive tape 41 or other suitable attachment means can be used to attach adjacent boxes 24 so as to maintain the boxes in a desired fixed orientation and to improve the integrity of the air barrier.

Figure 5:
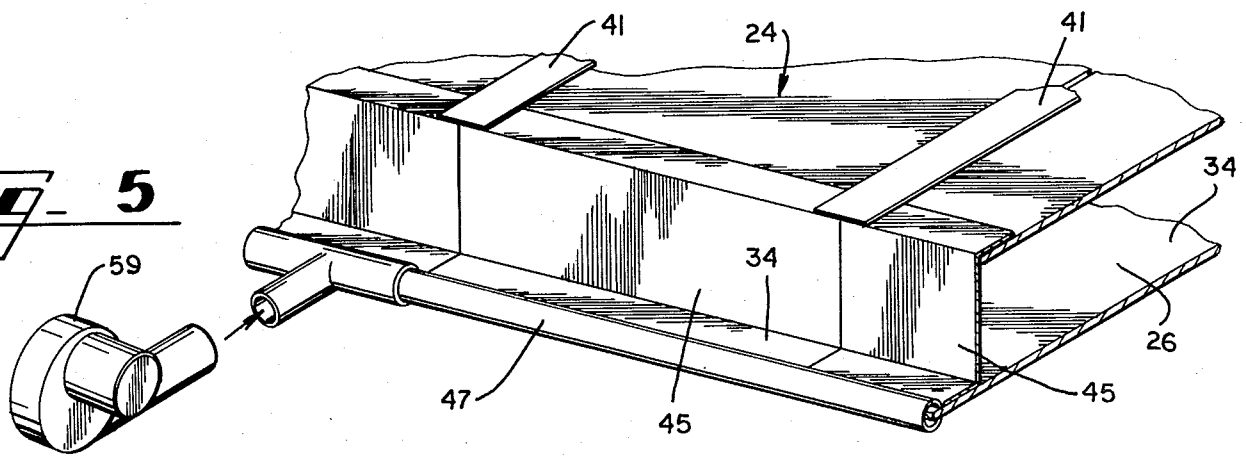
FIG. 5 is a partial perspective view of the boxes and the header.
Figure 4:
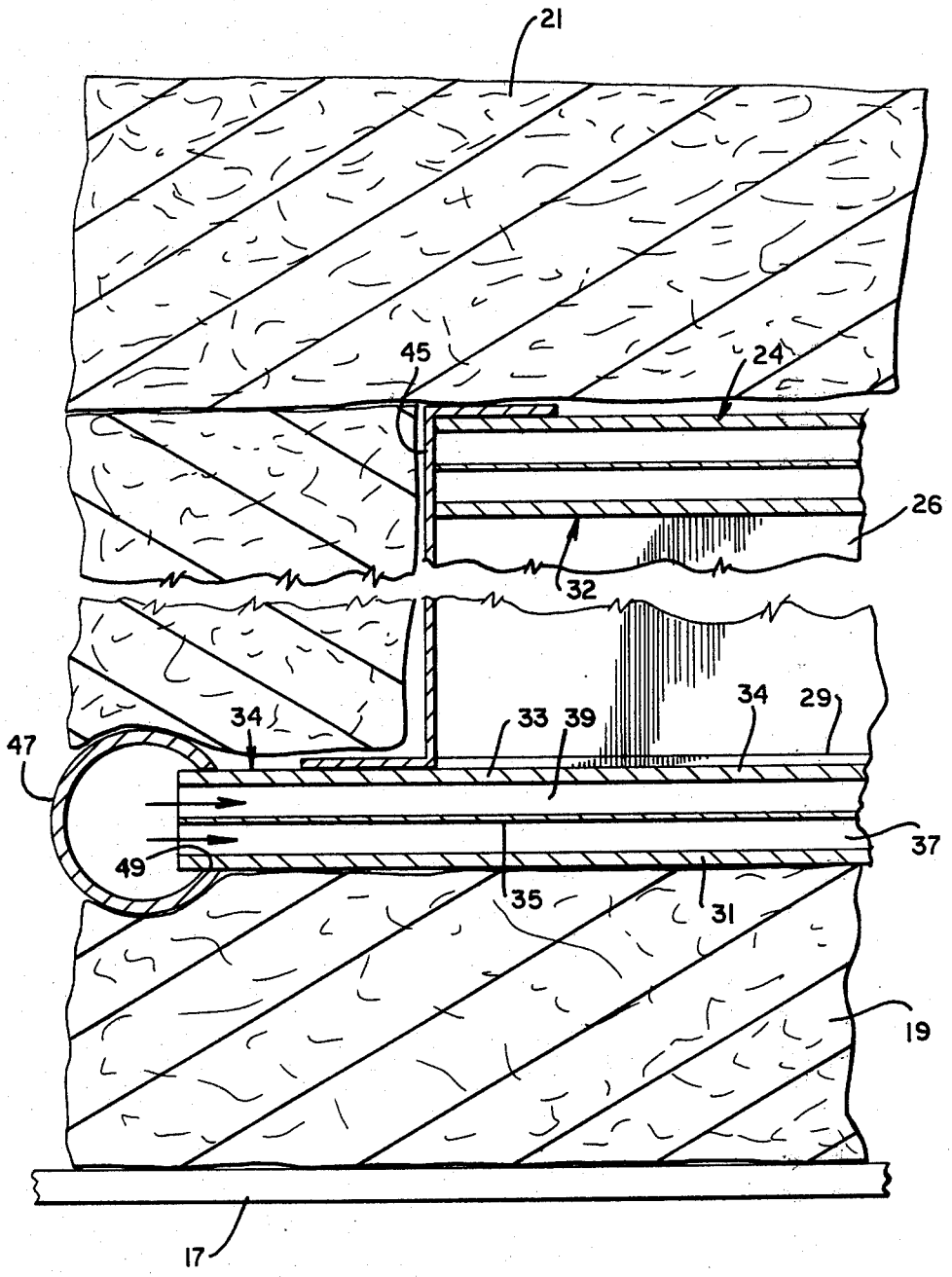
FIG. 4 is a side cross-sectional view of a box, its header and the surrounding static insulation.

As illustrated in FIGS. 4 and 5, the ends of the boxes 24 are closed by sheets 45 which are adhesively attached to the boxes upon erection and installation in the attic. This traps air in the chamber 26 of each box. The bottom wall 34 of each box protrudes beyond end sheet 45 and a manifold or header 47 is connected to one end edge of the bottom wall. Header 47 comprises an elongated conduit C-shaped in cross-section with a slot 49 formed along its side. The slot 49 is inserted about one edge portion of the bottom walls 34 of the boxes at one end of the boxes. The length of the header 47 is equal to the width spanned by the adjacent boxes 24 so that the open ended corrugated bottom wall 34 of each of the boxes 24 is connected to the header 47. Attachment of the header 47 to the bottom walls 34 of the boxes 24 can be achieved with adhesive tape (not shown) or other suitable attachment means.

Figure 2:
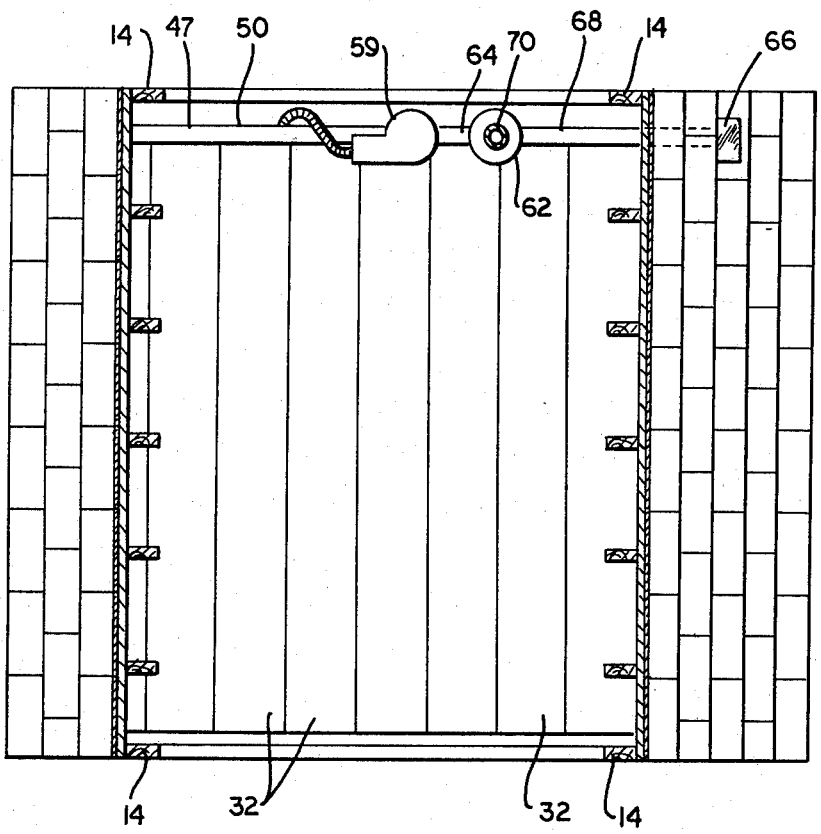
FIG. 2 is a top cross-sectional view taken along the line 2—2 of the attic and air insulation system shown in FIG. 1.

As illustrated in FIGS. 1 and 2, an electric fan or blower 59 is disposed adjacent the header 47 whose outlet is connected to the manifold 47 by a duct 60. The inlet of the fan 59 is connected to a heat exchanger 62 by a duct 64 and the heat exchanger is connected to a vent 66 on the outside of the roof by a duct 68. The header 47 therefore is in communication with the outside 20 through the duct 60, the fan 59, the duct 64, the heat exchanger 62, the duct 68 and the vent 66, and fan 59 and its vent 66 and ducts 64 and 68 function as means for moving air through the bottom wall 34 of box 24.

The heat exchanger 62 is essentially a cylindrical cannister having a vertical heat duct 70 passing through the center of the cannister to thereby define an annular chamber. The duct 70 is typically the flue of a furnace through which waste combustion gases of fuel burned in the furnace are exhausted to the outside 20. Air flowing through the annular chamber of the heat exchanger 62 about the vertical heat duct can undergo heat exchange with the exhaust gases from the furnace in the duct 70 and thereby be heated. Such heat exchangers are well known in the art.

The static insulation 19 is located between the joists below the boxes 24 and additional static insulation 21 such as loose blown insulation or batt insulation is positioned on top the boxes. Thus, the structure formed comprises the ceiling 17, lower insulation 19, boxes 24 and upper insulation 21. As an example of the static insulation desired, the lower insulation can be of a thickness sufficient to provide an R value of about 7 and the upper insulation 21 can be of a thickness sufficient to provide an R value of about 3.

Figure 6:
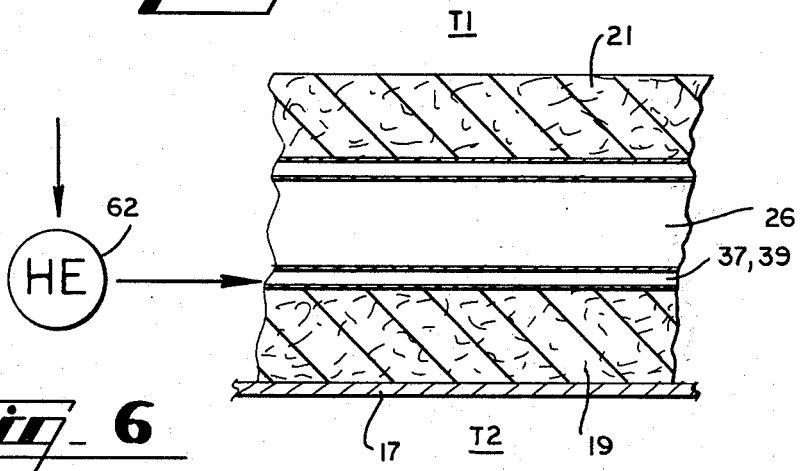
FIG. 6 is a detail cross section of a box of FIG. 3.

As schematically illustrated in FIG. 6, the flow of air through the elongated passages 37, 39 of the corrugated bottom walls 34 of the boxes 24 forms a plurality of parallel streams of air, or effectively a sheet or plane of moving air, across the insulation structure. The direction of heat transfer across the ceiling and static insulation and through the static air in chambers 26 is perpendicular to the plane of moving air, and the heat transfer or "movement" is relatively slow in comparison to the plane of moving air. Thus, the air movement tends to carry the heat in a direction which is at a right angle to the usual direction of heat transfer. This results in a much smaller amount of effective heat transfer across the insulation strucure.

The reflective aluminum foil which is laminated to the interior surfaces of the boxes 24 substantially traps the radiant heat and prevents its transfer. Also, the stagnant air in the air chambers 26 functions as a convection and conduction heat insulator.

Although the drawing figures illustrate the invention as including the air chambers 26 to maintain a layer of still air between the layers 19 and 21 of static insulation, the chambers 26 can be eliminated, if desired, and the reflective surface, such as aluminum foil 29, can be placed between the upper layer 21 of static insulation and the plane of moving fluid.

Operation of the insulation system will now be considered, giving separate consideration for summer and winter operation.

Figure 7:
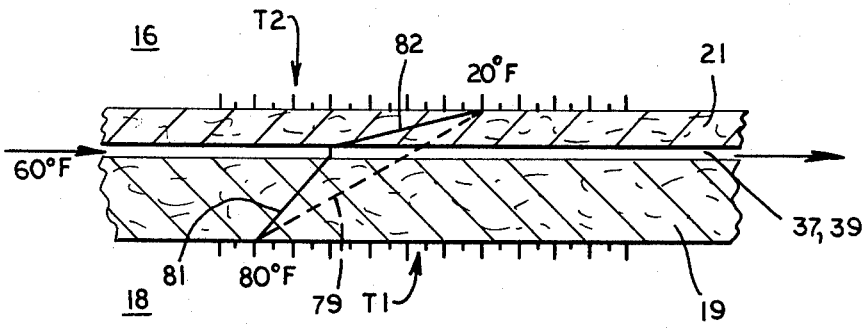
FIGS. 7 and 8 are temperature gradient diagrams of a structure using a form of the fluid flow insulation system as disclosed herein.

As illustrated in FIG. 7, which is a temperature gradient diagram of the fluid flow insulation system without the still air chamber, it will be assumed that the winter temperature of the air in the attic 16 is approximately 10°–20° F. It will also be assumed that the temperature of the room 18 is to be maintained at 72° F. resulting in an air temperature of about 80° F. adjacent the ceiling of the room. This temperature differential between the attic 16 and the room 18 produces a temperature gradient across the ceiling of approximately 60°–70° F. This results in a theoretical temperature gradient as illustrated by the dash line 79 which is substantially constant across the thickness of the structure. It will also be assumed that the temperature of the exhaust gases in the duct 70 of the heat exchanger 62 is approximately 60° F.

The fan 59 is turned on so that air from the outside 20 is drawn into the heat exchanger 62. As the air passes through the annular chamber of the heat exchanger 62 it undergoes heat exchange with the warmer exhaust gases in the duct 70. As a result the air is warmed from approximately 20° F. to approximately 60° F. This warmed air is then blown by the fan 59 into the header 47 and air passageways 37 and 39 formed in the bottom wall 34 of each box 24. Thus, the temperature between the static layers 19 and 21 of insulation material in the fluid passage 37, 39 is maintained at about 60° F. This temperature is between the relatively warm 80° F. temperature of room 18 and the relatively cold 20° F. temperature of the attic 16. The stream of 60° F. air is located close to the cold or undesirable temperature surface T2 in the attic, thus changing the normal temperature gradient 79 to a first gradual gradient 81 between the warm or desirable temperature surface T1 to the stream of fluid, and to a second more extreme temperature gradient 82 between the stream of fluid and the cold or undesirable temperature surface T2. The net result is that the rate of heat transfer from the desirable temperature surface T1 is reduced. After the air passes through the air passageways 37, 39, it exits the passageways and vents into the attic 16 thus raising the temperature of the air in the attic.

It will be appreciated by those skilled in the art that the movement of the 50°–60° F. air in a plane through the air passageways reduces the temperature gradient across the ceiling 17 and the lower layer of insulation 19 by approximately one-half. Assuming a power consumption of 60 watts per hour for a fan 59 suitable for a system having approximately 1,000 square feet of ceiling area, the total power used by the fan, operated on a continuous basis, is 1.44 kilowatt hours per day. A ceiling with an "R" value of 10 and a temperature gradient of 60° F. loses 6,000 BTU's per hour or 144,000 BTU's per day. By reducing the temperature gradient across the ceiling from 60° F. to 30° F., 72,000 BTU's per day can be saved at a cost of only 5,000 BTU's (1.44 KWH) of electricity for operation of the fan. Thus, it will be seen that the low-grade 60° F. heat of the exhaust gases in the heat exchanger, which is not useful for direct heating of the building, permits a recovery of approximately 7,000 BTU's per hour by the heat exchanger (assuming an outside air temperature of 0° F. and an air flow through the heat exchanger of 200 cubic feet per minute). It will also be seen that using a relatively low, 60° F., operating temperature for the heat exchanger permits it to be used in combination with other heat exchangers or economizers without affecting their performance.

Figure 8:
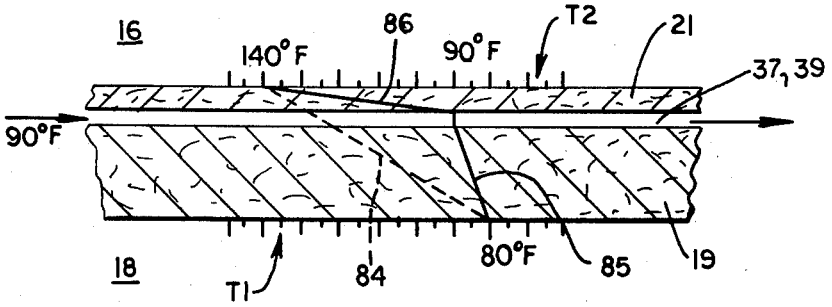

In summer, temperatures of 140° F. may be found in the attic producing a temperature gradient across the ceiling of approximately 60° to 70° F. By circulating outside air 20 of approximately 80°–90° F. through air passages formed between the layers 19 and 21 of static insulation, the temperature gradient can be reduced to less than one-half its former value. For example, FIG. 8 illustrates a temperature gradient of the fluid flow insulation system without the still air chamber, with summer attic temperature at 140° F. and room temperature at the ceiling at 80° F., giving a normal theoretical temperature gradient as illustrated by the dash lines 84 of 60° F. It is assumed that there will be no heat in the chimney 70 so that there is no heat to be transferred to the outside air being drawn by the fan 59 into the system.

The outside air moved through the passageways 37 and 39 is ambient air at a temperature of approximately 90° F. Thus, the temperature between the static layers 19 and 21 of insulation material in the fluid passageways 37, 39 is maintained at about 90° F. This temperature is between the moderate desirable 80° F. temperature of room 18 and the relatively hot 140° F. temperature of the attic 16. The stream of 90° F. air is located close to the hot or undesirable temperature surface T2 in the attic, thus changing the normal temperature gradient 84 to a first gradual gradient 85 between the moderate or desirable temperature surface T1 to the stream of fluid, and to a second more extreme temperature gradient 86 between the stream of fluid and the hot or undesirable temperature surface T2. The net result is that the rate of temperature transfer with respect to the desirable temperature surface T1 is reduced.

In this instance, using an air conditioner with an E.E.R. rating of 6.8, 3,000 watts of electricity per hour can be saved at a cost of 60 watts per hour spent by blowing the outside air through the boxes 24. Thus, the present invention saves energy in both summer and winter with the same apparatus. Since the furnace is not normally used during the summer, the heat exchanger 62 is essentially non-functional in the summer. Therefore, there is no need to use additional ducts or dampers when converting the system from summer operation to winter operation.

When the static air chambers 26 with their reflective surfaces are included in the structure they tend to reduce the transfer of heat in either direction, with the reflective surfaces reducing transfer of heat from radiation and the static air reducing transfer of heat from conduction and convection.

It will be noted that in both summer and winter conditions the stream of fluid passed between the layers of static insulation is at a temperature intermediate the temperatures at the outer surfaces of the layers of insulation, and that the stream of fluid is positioned so that it is relatively close to the undesirable temperature surface. By comparison, the same intermediate temperature in an unventilated structure would be closer to the desirable temperature surface. Thus, the rate of transfer of heat to or from the desirable temperature surface is altered by displacing the intermediate temperature position to a position closer to the undesirable temperature surface.

Although the disclosed embodiment of the invention has been described as being part of an attic of a residential dwelling, it will be understood that the particular type building structure disclosed herein is by way of example only and that the invention can be used in attics, walls, floors, etc. of various different structures.

Also, the particular box structure 24 has been described as having one corrugated sheet laminated between inside and outside sheets to form the multiple parallel channels for the movement of air; however, it will be understood that various other air passage means can be used, including multiple layers of corrugated sheet material, non-corrugated materials, spaced sheets of styrofoam and various other rigid or flexible materials. The fan 59 has been disclosed as part of the means for moving air through the air channels of the air passage means, but various other means can be used to induce air to flow through the air channels, including heat powered means such as solar powered air flow means or a heated exhaust conduit connected to the outlet ends of the air channels. While atmospheric air has been disclosed as the fluid medium, other gases or liquids can be used as the fluid medium. Moreover, it should be understood that the foregoing relates only to preferred embodiments of the present invention and that numerous modifications or alterations may be made therein without departing from the spirit and the scope of the invention as set forth in the appended claims.

I claim:

1. An air insulation system for an attic and the like wherein the attic defines an approximately horizontal support surface, said insulation system comprising an air duct system positioned on the support surface of the attic, said air duct system defining a plurality of air passages extending substantially parallel to one another and positioned closely adjacent one another, said plurality of passages being of a length and number to extend over substantially the entire support surface of the attic, and means for inducing air to move along the lengths of each of said passages from one end to the other end of each passage in closely adjacent parallel streams so that at least some of the heat transferred from one side of the air duct system to the air passages tends to be moved with the streams of air along the lengths of the passages.

2. The air insulation system of claim 1 and wherein said means for inducing air to move along the lengths of the passages comprises a manifold in communication with all of said air passages and fan means in communication with said manifold arranged to move air through said manifold and said passages.

3. The air insulation system of claim 2 and further including a heat exchanger, said fan means arranged to move air first through said heat exchanger and then through said air ducts.

4. An air insulation system for an attic and the like wherein the attic defines an approximately horizontal support surface, said insulation system comprising an air duct system positioned on the support surface of the attic, said air duct system defining air passages sized and shaped to extend over substantially the entire support surface of the attic, said air passages comprising a plurality of collapsible corrugated wall boxes arranged in side-by-side abutment, and means for inducing air to move through said air passages.

5. An air insulation system for an attic and the like wherein the attic defines an approximately horizontal support surface, said insulation system comprising an air duct system positioned on the support surface of the attic, said air duct system defining air passages sized and shaped to extend over substantially the entire support surface of the attic, said air passages being formed from collapsible corrugated wall boxes with the inside surfaces of the walls of the boxes defining a static air chamber having heat reflective surfaces, and means for inducing air to move through said air passages.

6. An air insulation system for an attic and the like wherein the attic defines an approximately horizontal support surface, said insulation system comprising an air duct system positioned on the support surface of the attic, said air duct system defining air passages sized and shaped to extend over substantially the entire support surface of the attic, said air passages being formed from a corrugated sheet structure including a corrugated sheet with flat sheets laminated to its opposite surfaces whereby a plurality of air channels are formed between said flat sheets, and means for inducing air to move through said air passages.

7. An air insulation system for an attic and the like wherein the attic includes parallel joists, sheet material connected to the lower surfaces of the joists, and a lower layer of static insulation material positioned between the joists, said air insulation system comprising an air duct system for placement on the upper surfaces of the joists and sized and shaped to extend over substantially all of the joists, said air duct system comprising a plurality of substantially parallel closely spaced air conduits open at their opposite ends, a manifold in communication with each air conduit at one of its ends, and means for inducing a flow of air along the lengths of all of said air conduits and through said manifold so as to effectively for a sheet of air moving over the lower layer of static insulation, and an upper layer of static insulation located on top of said air duct system, so that at least some of the heat transferred through either the lower layer of static insulation or through the upper layer of static insulation to the air duct system tends to be moved with the sheet of moving air.

8. The air insulation system of claim 7 further comprising means for circulating outside air through said air duct system.

9. The air insulation system of claim 7 further comprising means for circulating through said air duct system air heated by waste combustion gases from a furnace or the like.

10. An air insulation system for an attic and the like wherein the attic includes parallel joists, sheet material connected to the lower surfaces of the joists, and a layer of static insulation material positioned between the joists, said air insulation system comprising an air duct system for placement on the upper surfaces of the joists and sized and shaped to extend over substantially all of the joists, and a layer of static insulation located on top of said air duct system, said air duct system comprising sheet material with laminations of at least one corrugated sheet and a flat sheet whereby a series of rectilinear parallel passageways are formed for the flow of air along their lengths.

11. The air insulation system of claim 7 and further including a heat exchanger attached to the exhaust flue of a furnace or the like, and means for moving air from said heat exchanger through said air duct system.

12. The air insulation system of claim 7 and further including a plurality of static air chambers with reflective surfaces positioned between the layers of static insulation.

13. A method of insulating an attic or the like during summer or other relatively warm periods, said attic defining a substantially horizontal support surface, comprising the step of moving outside air having a temperature lower than the temperature of air in said attic through a plurality of air passages extending substantially parallel to one another and positioned closely adjacent one another to effectively create a sheet of moving air along a horizontal plane extending over substantially the entire support surface of the attic.

14. A method of insulating an attic or the like of a dwelling during winter or other relatively cold periods, said attic defining a substantially horizontal support surface, said method comprising the steps of heating air by heat exchange with waste heat from the dwelling to a temperature greater than the temperature of air in the attic, and moving the heated air through a horizontal plane extending over substantially the entire support surface of the attic along a plurality of closely spaced parallel passages.

15. A heat insulation structure comprising at least two layers of static heat insulation material, and an air duct system formed between said layers of static heat insulation material, said air duct system comprising a plurality of closely spaced substantially parallel air passages in a common plane and of a length and number to span the space to be insulated and means for moving air from the atmosphere through said air duct system, from one end to the other end of said passages, to effectively form a sheet of moving air between the layers of insulation.

16. The invention of claim 15 and further including a heat exchanger, and wherein said means for moving air comprises moving air from the atmosphere through said heat exchanger and through said air passage.

17. The invention of claim 15 and further including a static air chamber positioned between said layers of static insulation material.

18. A method of heat insulating adjacent areas wherein layers of static heat insulation material are positioned between the areas of contrasting temperature with one surface of the static heat insulation material located adjacent a relatively cold temperature and another surface of the static heat insulation material located adjacent a relatively hot temperature, comprising the step of moving a sheet of air between the layers of heat insulation material at a temperature and position such that the ratio of the difference between the temperature of the sheet of air from the temperature at one outside surface of the static heat insulation material is greater than the ratio of the distance of the stream of air from the one outside surface of the static insulation material to the distance between the opposite outside surfaces of the static insulation material, so that an intermediate temperature in the static heat insulation material is displaced to a position closer to one surface of the static heat insulation material.

19. A heat insulation structure comprising layers of static heat insulation material with one surface of the static insulation material located adjacent a relatively cold temperature and another surface of the static insulation material located adjacent a relatively hot temperature, and means for moving a sheet of air between the layers of static heat insulation material at a temperature and distance from one surface of the static insulation material so that the raio of the difference between the temperature of the sheet of air from the temperature at one outside surface of the static heat insulation material is greater than the ratio of the distance of the stream of air from the one outside surface of the static insulation material to the distance between the opposite outside surfaces of the static insulation material so as to displace an intermediate temperature of the static heat insulation material to a position closer to one of the outside surfaces of the static heat insulation material.

* * * * *